US005711052A

United States Patent [19]

Delaske

[11] Patent Number: 5,711,052

[45] Date of Patent: Jan. 27, 1998

[54] ADJUSTABLE WINDOW HINGE

[75] Inventor: Robbin J. Delaske, Waterville, Minn.

[73] Assignee: Truth Hardware Corporation, Owatonna, Minn.

[21] Appl. No.: 744,005

[22] Filed: Nov. 4, 1996

[51] Int. Cl.[6] ..... E05D 15/06

[52] U.S. Cl. ..... 16/364; 16/340; 16/245

[58] Field of Search ..... 16/364, 368, 369, 16/340, 240, 245, 237, 238, 374, 375, 370, 371; 49/248–252, 452, 181

[56] References Cited

U.S. PATENT DOCUMENTS

| | | | |
|---|---|---|---|
| Re. 32,846 | 1/1989 | Sandberg et al. . | |
| 1,499,540 | 7/1924 | Lea . | |
| 1,710,171 | 4/1929 | Lindsay . | |
| 2,688,779 | 9/1954 | Westman . | |
| 2,839,778 | 6/1958 | Hutchinson et al. | 16/245 |
| 2,842,795 | 7/1958 | Majeske | 16/245 |
| 2,926,397 | 3/1960 | Vuncannon . | |
| 3,054,447 | 9/1962 | Brydolf | 16/245 |
| 4,674,149 | 6/1987 | Vetter . | |
| 4,726,092 | 2/1988 | Tacheny et al. . | |
| 4,790,106 | 12/1988 | La See . | |
| 4,833,754 | 5/1989 | Yang . | |
| 4,986,028 | 1/1991 | Schneider et al. | 16/370 |
| 5,074,075 | 12/1991 | La See . | |
| 5,152,102 | 10/1992 | La See . | |

FOREIGN PATENT DOCUMENTS

| | | |
|---|---|---|
| 376488 | 7/1932 | United Kingdom . |
| 1137878 | 12/1968 | United Kingdom . |

*Primary Examiner*—Chuck Mah

*Attorney, Agent, or Firm*—Wood, Phillips, VanSanten, Clark & Mortimer

[57] ABSTRACT

An adjustable window hinge having a stop bracket securable to the hinge track, a set bracket securable to the window frame adjacent the hinge track and an adjustable screw threaded through an upright wall of the set bracket to contact the stop bracket and control the position of the hinge track relative to the frame.

16 Claims, 2 Drawing Sheets

ADJUSTABLE WINDOW HINGE

BACKGROUND OF THE INVENTION

Adjustment hinges are known in the art and have been used to correct sash sag in awning and casement style windows. Casement windows pivot along the upright portions of a window frame while awning windows pivot along the top part of the frame to swing the bottom window edge outward.

Sash sag is the condition that occurs in casement and awning windows when the sash portion of a window is out of square with the frame. This misalignment between the window sash and frame can be caused by faulty installation of the window unit, settling of the building, and warpage caused by weathering.

A window with sash sag is not properly sealed and will allow wind, moisture and dust to enter the structure. This can disrupt the interior temperature and humidity, as well as increase the amount of dust and germs. In a hospital setting or the like, such conditions are intolerable and can be hazardous to an individual's health. In a residential or commercial setting, the increased dust, moisture and wind not only disrupts the internal environment, but also can damage personal property. When sash sag is not corrected, moisture will seep into the broken seal and cause structural damage to the window frame and the surrounding supporting wall.

Prior art adjustment devices are labor intensive, often requiring some disassembly of the hinge to make adjustments. This increases the time necessary for adjustment and the cost of producing complex adjustment devices. Also, prior art adjustment devices do not offer precise incremental adjustments to correct sash sag.

For the foregoing reasons, there is a need for a hinge adjustment device that is easy to use and simply constructed, offering precision adjustment of the window sash in order to correct any misalignment.

SUMMARY OF THE INVENTION

In one aspect of the invention an adjustable hinge having a track with a slidable shoe, pivotable support mount and a pivotable sash arm is disclosed. A stop bracket is securable to the track, a set bracket securable to the window frame adjacent the track, and a spacing controller controls the position of the track relative to the window frame.

In another aspect of the invention the spacing controller is an adjustable screw.

In a further aspect of the invention, a repositionable hinge for controlling the position of a window sash relative to a window frame comprises a track securable to a window frame, a shoe sliding on the track, a hinged linkage having at least one arm pivotable on the track and another arm pivotable on the shoe, a stop bracket secured to the track, a set bracket secured to the window frame adjacent the stop bracket, and an adjustable screw threaded through the set bracket and engaging the stop bracket for adjustably controlling the position of the track relative to the window frame.

In another aspect of this invention, a repositionable hinge for controlling the position of a window sash relative to a window frame comprises a track securable to a window, a shoe slidable on the track and a hinged linkage. The hinged linkage includes a first sash arm securable to a window sash, a first support arm pivoted on one end to the track and at a second end to the first sash arm, a second support arm pivoted at one end to the shoe and at a second end on the first sash arm, and a third support arm pivoted at one end to the shoe and at a second end pivoted to the first support arm. A stop bracket is secured to the track and a set bracket is securable to a window frame adjacent the track such that a screw extending through a threaded opening of the set bracket will engage the stop bracket to adjustably control the position of the track relative to the window frame.

It is an object of this invention to provide an easy to use and inexpensive hinge adjustment device that offers precision and incremental adjustment of a hinge to correct sash sag.

DESCRIPTION OF THE PREFERRED EMBODIMENT

A hinge assembly is generally made up of a track secured to a window frame, a shoe which slides along the track, a sash arm secured along the window sash and pivotable relative to the shoe, and at least one support arm having one end pivoted to the track and the other end pivoted to the sash arm.

Figure 1:
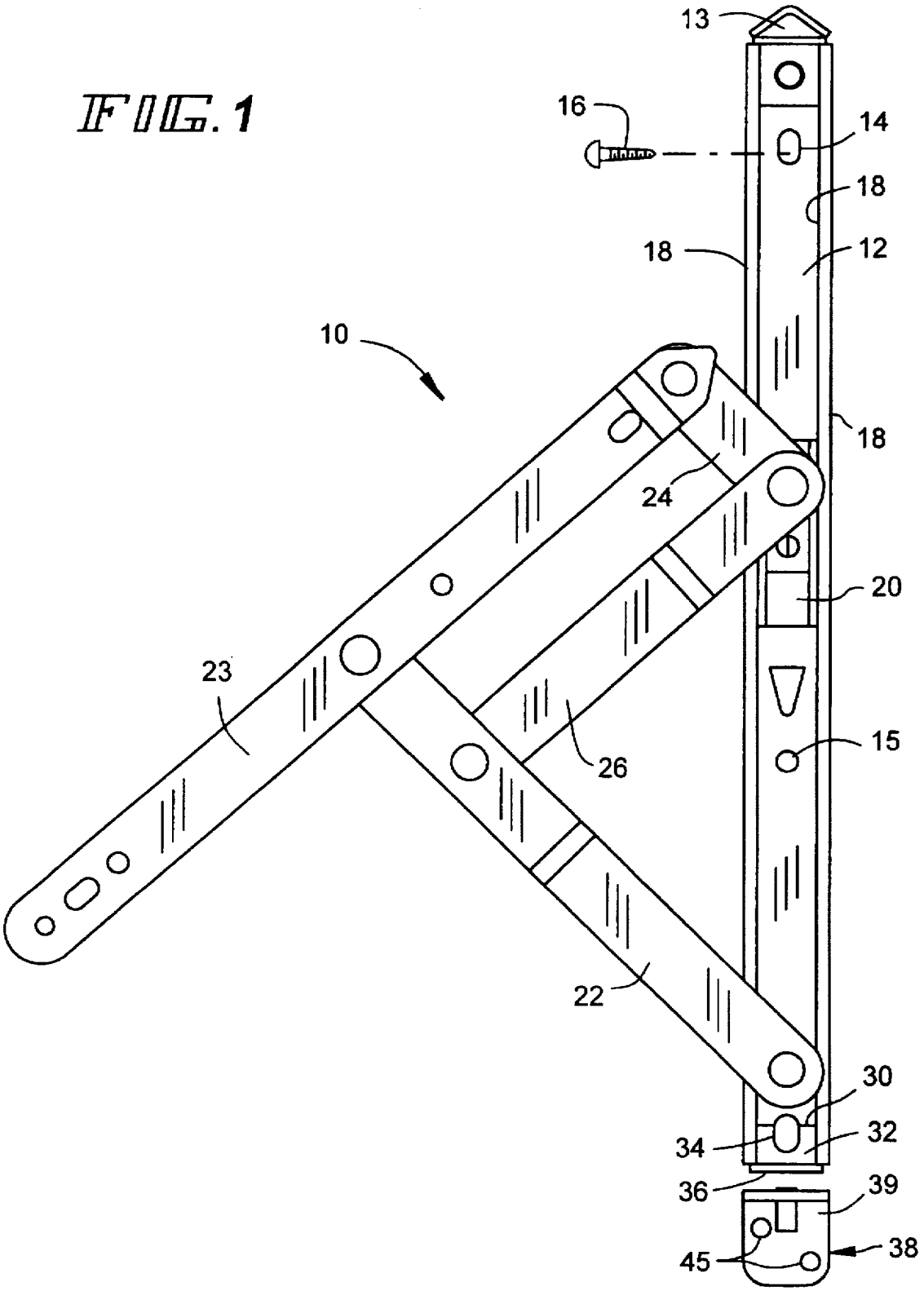
FIG. 1 is a plan view of the preferred embodiment.

A hinge assembly 10 is shown in FIG. 1 along with the improvements of this invention. A track 12 with slots 14 and hinge anchoring hole 15 is mounted to a window frame by screws 16 which extend through slots 14 into the window frame. The screws 16 are No. 10 Phillips pan head screws, with length and tread type to be determined for each individual application. The track 12 also has a guide channel 18 and a shoe 20 slidable along the track 12. A first support arm 22 is pivoted at a first end on the track 12 and is pivotally attached at a second end to a sash arm 23. The sash arm 23 is secured to an edge of the window sash (not shown) and is pivotally secured to a first end of a second support arm 24. The second end of the second support arm 24 is pivotally secured to the shoe 20. In the preferred version of the invention, a third support arm 26 is pivotally connected at a first end to the shoe 20 and at a second end to the first support arm 22.

Figure 2:
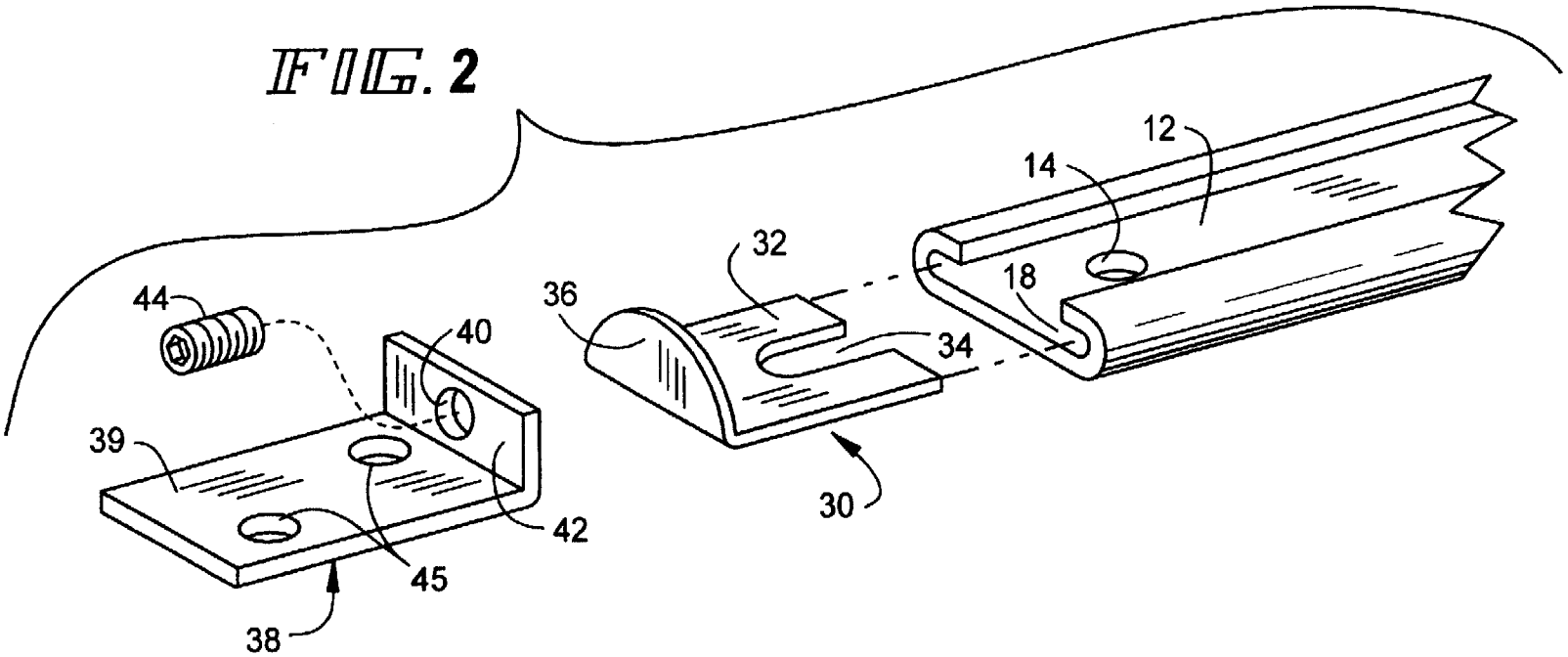
FIG. 2 is an exploded perspective view of the set bracket, stop bracket and track.

A stop bracket 30 has a base portion 32 having a slot 34, and an abutment face portion 36 (FIG. 2). The abutment face portion 36 is generally perpendicular to the base portion 32. The base portion 32 is insertable to the track guide channel 18. The base portion screwholes 34 are alignable with a track slot 14 and securable to the track 18 by a screw 16.

Set bracket 38 has a base portion 39 and a flange portion 40. The flange portion 42 has a threaded opening 40 through which an adjustable screw 44 can be threaded. The base portion 39 of set bracket 38 has screwholes 45 through which screws 16 are threaded to secure the set bracket 38 to the window frame. The adjustable screw 44 can be threaded through the flange portion threaded opening 40 of the set bracket 38 to contact the abutment face portion 36 of the stop bracket 30. All parts of the hinge assembly 10 are stainless steel.

The operation of this version of the invention is as follows. The adjustable hinge 10 is used with an awning or casement style window. The track 12 is secured to the window frame by screws 16 extending through slots 14. The sash arm 23 is mounted to the window sash, and connects to the window frame through hinge assembly 10. Because the track 12 is initially loosely mounted to the window frame through slotted mounting holes 14, the track 12 has a limited range of motion on the window frame during this initial mounting. The maneuverability of the track 12 on the window frame allows the window sash to be properly positioned in the window frame.

In the first version of the invention a base portion 32 of the stop bracket 30 is inserted into the guide channel 18 of the track 12. The abutment face portion 36 of the stop bracket 30 extends generally perpendicular to the window frame. Adjacent the stop bracket 30 is a set bracket 38 which is secured at its base portion 39 to the window frame so that the flange portion 42 is adjacent and in a parallel plane with the abutment face portion 36 of the set stop bracket 30. The adjustable screw 44 is threaded into the threaded opening 40 on the flange portion 42 to extend through the flange portion 42 and to contact the abutment face portion 36 of the stop bracket 30. As the adjustable screw 44 is turned, the screw 44 pushes into the abutment face portion 36 of stop bracket 30. This force translates into a pushing force on the track 12. Because the track 12 is initially loosely mounted, this pushing force exerted by the adjustable screw 44 changes the position of the track 12. The force pushing the track 12 is controlled by rotation of the adjustable screw 44 such that any rotation of the adjustable screw 44 causes an incremental adjustment to the track 12. This allows the position of track 12 to be fine tuned to alleviate any misalignment. Once the proper adjustment is made, the mounting screws 16 in the slotted holes 14 are completely fastened into place, and a screw 16 is fastened through the anchor hole 15 to further secure the hinge 10.

If the track 12 is on a vertical portion of the window frame, then only one stop bracket 30 and set bracket 38 at the lower end of the track 12 are necessary. In this case the adjustable screw 44 will push the track 12 against the force of gravity. Gravity will constantly be pulling the track 12 back toward its original position. In such applications, the track 12 can have a cap 13 on the end opposite the adjustment bracket to receive and align the sash arm 23 in a closed position (FIG. 1).

Figure 3:
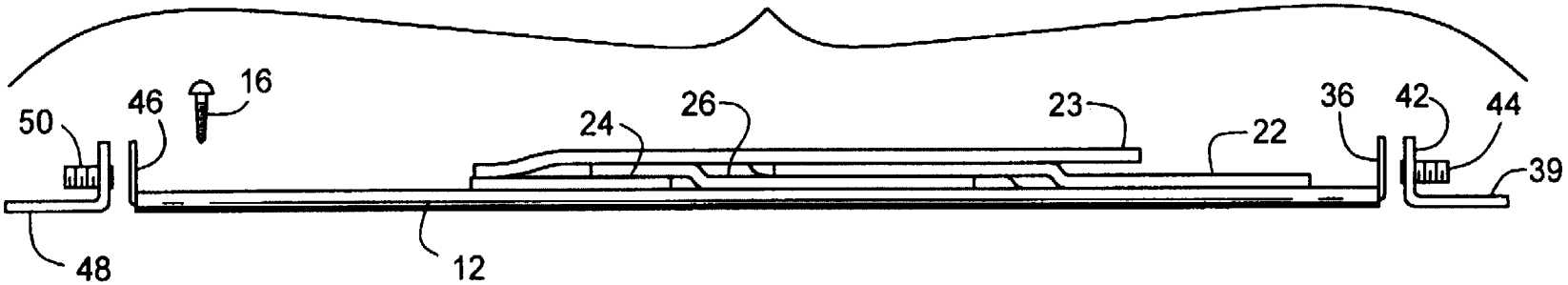
FIG. 3 is a side view of an alternate embodiment.

In an alternate version of the invention (FIG. 3), the track 12 is secured to a horizontal portion of the window frame, and a second stop bracket 46 can be affixed to the track 12 at the other end of the track 12. A second set bracket 48 is then affixed adjacent to the second stop bracket 46 and a second adjustable screw 50 is insertable to the second set bracket 48. In this version of the invention, if the first adjustable screw 44 pushes the track 12 too far in a first direction then the second adjustable screw 50 can be used to push the track 12 back in the opposite direction to correct the alignment.

In either version, when the proper alignment is determined, the screws 16 are set into the window frame through slots 14 and anchor hole 15 to secure the track 12.

The adjustment mechanism can be applied by the window manufacturer at the time the hinge is applied, or it can be applied in the field when the complete window and frame are put into the framed opening of the structure.

This adjustable window hinge is a simple device that will decrease manufacturing costs. It is reliable and easy to operate, requiring no special expertise to use. Thus an individual can correct sash sag on his own with a minimum of effort and cost. This hinge corrects sash sag more efficiently than does the prior art because it provides incremental adjustments to the track 12 as the adjustable screw 44 is rotated.

I claim:

1. In a hinge having a track securable to a window frame, a shoe slidable on said track, at least one support arm pivotable on said track, and at least one sash arm pivotable relative to said shoe, the improvement comprising:

(a) a stop bracket securable to a track;

(b) a set bracket securable to a window frame adjacent said track and spaced from said stop bracket; and (c) a means for adjustably controlling the spacing between said stop bracket and said set bracket to control the position of said track relative to said frame.

2. The hinge of claim 1 wherein the means for adjustably controlling the spacing between said stop bracket and said set bracket is an adjustable screw.

3. The hinge of claim 2 wherein the set bracket further has a threaded opening therethrough, through which said adjustable screw is threaded into engagement with said stop bracket to adjustably control the position of said track relative to said frame.

4. In a hinge having a track securable to a window frame, a shoe slidable on said track, at least one support arm pivotable on said track, and at least one sash arm pivotable relative to said shoe, the improvement comprising:

(a) a stop bracket securable to a track;

(b) a set bracket securable to a window frame adjacent a track having said stop bracket secured thereto, said set bracket having a flange projecting outwardly from a frame when secured thereto, said flange having a threaded opening therethrough; and (c) an adjustable screw threaded through said threaded opening into engagement with said stop bracket for adjustably controlling the position of a track relative to a frame to which said set bracket is secured.

5. The hinge of claim 4 wherein the stop bracket further has a base portion securable to a track and an abutment face portion.

6. The hinge of claim 5 wherein the screw engages said abutment face portion of said stop bracket.

7. The hinge of claim 5, further comprising:

a track to which said stop bracket is securable wherein said track has a slot and said stop bracket base portion has a slot aligned with said track slot; and a securing screw insertable through said aligned slots and into a frame to secure said hinge in a desired position.

8. The hinge of claim 7 wherein said track has at least one guide channel into which said stop bracket base portion is slidably insertable.

9. The hinge of claim 4 further comprising:

a second stop bracket securable to a track at an end opposite said first set bracket;

a second set bracket securable to a window frame adjacent a track having said first and second stop brackets secured thereto, said second set bracket having a flange projecting outwardly from the frame to which said first and second set brackets are secured, said second set bracket flange having a threaded opening therethrough; and a second adjustable screw threaded through said second set bracket threaded opening into engagement with said second stop bracket for adjustably controlling the position of a track relative to a frame to which said first and second set brackets are secured.

10. The hinge of claim 4 wherein a track is mounted to a vertical portion of an awning window frame with said bracket securable beneath the track.

11. A repositionable hinge for controlling the position of a window sash relative to a window frame, comprising:

a track having a plurality of holes for use in securing said track on a window frame;

a shoe slidable on said track;

a hinge linkage having at least one arm pivotable on said track and a second arm pivotable on said shoe;

a stop bracket secured to said track;

a set bracket securable to the window frame adjacent said track, said set bracket having a flange projecting outwardly from the window frame, said flange having a threaded opening therethrough; and a screw in said threaded opening and engaging said stop bracket for adjustably controlling the position of said track relative to the window frame.

12. The repositionable hinge of claim 11 wherein the stop bracket has a base portion mounted to said track and an abutment face portion projecting outwardly from the frame when said track is secured thereto.

13. The repositionable hinge of claim 12 wherein said screw engages said abutment face portion.

14. The repositionable hinge of claim 13 wherein a guide channel is integral to said track.

15. The repositionable hinge of claim 13 wherein said track is mountable to a vertical portion of an awning window frame, and said stop bracket and said set bracket are secured adjacent a lower end of the track.

16. A repositionable hinge for controlling the position of a window sash relative to a window frame, comprising:

a track having a plurality of mounting holes for use in securing said track to a window frame;

a shoe slidable on said track;

a hinge linkage including a first sash arm securable to a window sash, a first support arm having one end pivotally secured to said track and a second end pivotally secured to said first sash arm, a second support arm having one end pivotally secured to said shoe and a second end pivotally secured to said first sash arm, and a third support arm having one end pivotally secured to said shoe and a second end pivotally secured to said first support arm;

a stop bracket secured to said track;

a set bracket securable to a window frame adjacent the track, said set bracket having a flange projecting outwardly from a window frame, said flange having a threaded opening therethrough; and a screw in said threaded opening and engaging said stop bracket for adjustably controlling the position of the track relative to the window frame.

* * * * *